US005868345A

United States Patent [19]

Beisser

[11] Patent Number: 5,868,345

[45] Date of Patent: Feb. 9, 1999

[54] TOILET PAPER DISPENSER

[76] Inventor: Franz X. Beisser, Rte. 6, Box 262 B, Bedford, Va. 23523

[21] Appl. No.: 990,659

[22] Filed: Dec. 15, 1997

[51] Int. Cl.[6] ..... B65H 16/02; B65H 16/06

[52] U.S. Cl. ..... 242/592; 242/598

[58] Field of Search ..... 242/592, 591, 242/598.5, 598

[56] References Cited

U.S. PATENT DOCUMENTS

| | | | |
|---|---|---|---|
| 1,104,284 | 7/1914 | Wood | 242/592 |
| 2,574,175 | 11/1951 | Erhardt | 242/592 |
| 4,200,245 | 4/1980 | Bugnone | 242/592 |
| 5,664,740 | 9/1997 | Alderman et al. | 242/592 |

*Primary Examiner*—John Q. Nguyen

[57] ABSTRACT

A toilet paper dispenser includes a base assembly and a slider assembly. The base assembly is fixedly mounted, alongside a toilet, to a support structure such as a vanity. The slider assembly is adapted to slide or translate longitudinally relative to the base assembly. At one end of the slider assembly is located a toilet paper holder. In operation, the slider assembly can be set to a retracted position where the toilet paper roll holder will be stored out of way. When it is desired to use the toilet paper dispenser, the slider assembly may be extended so that someone using the toilet paper may obtain the paper without having to unnecessarily twist or turn.

15 Claims, 3 Drawing Sheets

TOILET PAPER DISPENSER

BACKGROUND OF THE INVENTION

1. Field of the Invention

The present invention pertains to the art of toilet paper dispensers and, more particularly, to toilet paper dispensers which are adjustable by the user.

2. Discussion of the Prior Art

It is widely known in the art to provide a toilet paper dispenser for rotatably mounting a toilet paper roll near a toilet in a restroom. Typically such devices are mounted to a wall or other supporting structure near a toilet for access when someone is using the toilet. For obvious reasons, ease of access to the toilet paper roll is desirable in this field of the art.

Most toilet paper dispensers are mounted on a wall found adjacent to a toilet. For example, on a tile wall, a few tiles may be cut out and a ceramic toilet paper dispenser will be glued to the wall in an easily accessible position. Typically these dispensers have two arms which extend from the wall and support a mandrel therebetween. The toilet paper roll is supported rotatably by the mandrel and toilet paper is dispensed by rotating the toilet paper roll. Of course, the one major drawback of this type of arrangement is that occasionally there is no wall along the side of the toilet. Also, even if there is a wall along the side of a toilet, ceramic-type toilet paper dispensers are difficult for a homeowner to install on their own and typically require a lot of skill and expense to replace if they break.

It has heretofore been proposed, in order to overcome the problem of mounting a toilet paper dispenser near a toilet when no side wall is present, to either mount the toilet paper dispenser on a wall behind the toilet or in some cases on a vanity which is commonly found in a restroom beside a toilet. Of course, a major problem with mounting a toilet dispenser directly beside or behind the user is that a lot of twisting, turning and other uncomfortable motions must be made to retrieve the toilet paper from the toilet paper dispenser.

U.S. Pat. No. 1,226,453 recognizes the problem of boring holes in the wall of a restroom to enable a dispenser be connected thereto and suggests a dispenser which is mounted on a bolt which holds a toilet seat onto a toilet. Essentially, the dispenser comprises a couple of pieces of thick metal wire with one end being attached to the bolt of the toilet seat and the other end supporting a mandrel for mounting of the toilet paper roll. Unfortunately, although this toilet paper dispenser does not need to be mounted on a wall, it does have at least one major drawback. More specifically, it is difficult to adjust in that, while it does extend to a position where a user can more easily access the toilet paper, it does not retract so as to be out of the way when not in use. While such a feature was not necessary so much with a toilet paper dispenser mounted on a forwardly extending side wall, it becomes particularly important when the toilet paper dispenser is suspended in a position along side a toilet.

Several other individuals have come up with mechanisms for dispensing toilet paper. However, they tend to address radically different problems from the one at issue. U.S. Pat. No. 2,459,252 to Strahan discloses a toilet paper cabinet and dispenser. In Strahan's arrangement, a toilet paper holder may be extended from the cabinet to an in-use position or retracted into the cabinet in order to be hidden from view. While this patent does disclose a toilet paper holder which is extendable and retractable, it does not address the problem of mounting the entire unit when a side wall is not available. The entire cabinet structure of Strahan has to be located directly on some type of wall or other similar supporting structure located in a restroom and if the only available supporting structure is the back wall, for example, the toilet paper will still not be easily accessible despite Strahan's arrangement.

U.S. Pat. No. 4,422,585 to Schultz et al. also discloses a toilet paper dispenser having a movable mandrel. However, this apparatus is concerned with providing two paper rolls in a public restroom. Essentially when one paper roll is used a mandrel supporting a second paper roll is able to slide from a recessed position to an accessible position.

Therefore, there exists a need in the art to provide a toilet paper dispenser which can be mounted next to a toilet without the benefit an adjacent side wall extending in front of and alongside said toilet which can nevertheless place the toilet paper roll in a position where it can easily be accessed and used by someone using the toilet and yet be retracted into a position where it will not interfere with other uses of a restroom.

SUMMARY OF THE INVENTION

The invention proposes a toilet paper dispenser for dispensing toilet paper from a roll, comprising a base assembly and a slider assembly slidably mounted thereon. The base is made of three parts. Specifically, it is provided with two parallel tracks, each having a groove therein, wherein the tracks are connected and spaced from each other by a flat hardboard plate. Each track has two mounting holes for use in mounting the toilet paper dispenser to a vanity or other support surface by screws or nails. The slider assembly is an elongated rectangular board having two tongues which cooperate with the aforementioned tracks to enable the slider assembly to easily slide from a retracted position to an extended position. At one end of the slider assembly, two brackets extend transversely therefrom, with each bracket being provided with a mounting hole for a mandrel which is designed to hold the roll of toilet paper.

With this arrangement, when the toilet paper dispenser is mounted horizontally along the side wall of a vanity or the like, the slider assembly can be placed in a retracted position where the slider assembly and base assembly are disposed so as not to interfere with regular activities of the restroom. However, when the toilet paper dispenser is in use, the slider assembly can be extended linearly outward from the base so as to enable the toilet paper to be easily accessible by someone using the toilet, without him/her having to twist, turn or bend in an uncomfortable position, as is necessary in several prior art devices. Also, this obviates the need for having a side wall that extends forward of a user of the facilities adjacent the toilet in order to provide support for the toilet paper dispenser.

Additional features and advantages of the toilet paper dispenser of the present invention will become more readily apparent from the following detailed description of a preferred embodiment thereof when taken in conjunction with the drawings wherein like reference numerals refer to corresponding parts in the several views.

DETAILED DESCRIPTION OF THE PREFERRED EMBODIMENTS

Figure 1:
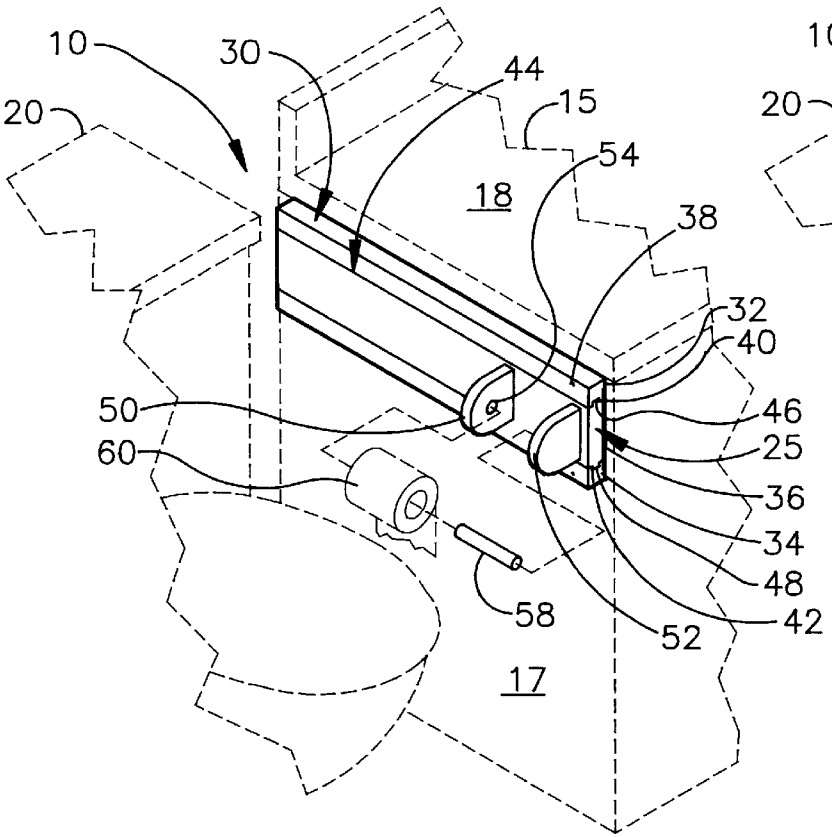
FIG. 1 is a partially exploded perspective view of a toilet paper dispenser in its retracted position according to a preferred embodiment of the invention.

As illustrated in FIG. 1, a toilet paper dispenser 10 is mounted on a vanity 15. Specifically, the toilet paper dispenser 10 is mounted on the side wall 17 of the vanity 15 adjacent its countertop 18. Adjacent the vanity 15, there is located a conventional toilet 20. Since both the vanity 15 and the toilet 20 are extremely well known in the art, their construction will not be discussed here. They are merely shown to help understand the preferred embodiment of the invention relating to the toilet paper dispenser 10.

The toilet paper dispenser 10, which is generally symmetrical about a longitudinal plane, is composed of two major components: a slider assembly 25 and a base assembly 30. The base assembly 30 is composed of three basic components. A first track 32, a second track 34 and a hard board backing plate 36, all made of wood, plastic or some other known material. The first and second tracks 32 and 34 generally extend parallel to one another in a longitudinal direction. They are connected by the hard board backing plate 36 which also extends in the longitudinal direction and keeps the two tracks 32 and 34 properly spaced. The two tracks 32 and 34 may be mounted to the hardboard by any suitable means such as adhesive or other type of fastener. Preferably, each track 32 and 34 has a recessed groove into which the hard board backing 36 fits so as to provide the entire base assembly 30 with a smooth surface so that it may be easily mounted on a supporting structure such as the vanity 15.

Each track 32 and 34 has a pair of spaced mounting holes 38 which are adapted to receive mechanical fasteners such as a round head brass screw. Preferably a total of four mechanical fasteners will be placed in the base assembly 30, to firmly secure it to the side wall 17 of the vanity 15. Preferably, as most clearly shown in FIGS. 1 and 2, the base assembly 30 is mounted horizontally near the top of the wall 17 adjacent the countertop 18. It will be noted that the entire paper dispenser assembly 10 is symmetrical about a plane running through its longitudinal axis and, therefore, may be easily mounted on either side of the toilet 20 even when the vanity 15 is not located to the right of the toilet 20 as shown in FIG. 1, but rather is located to the left of the toilet 20.

Figure 2:
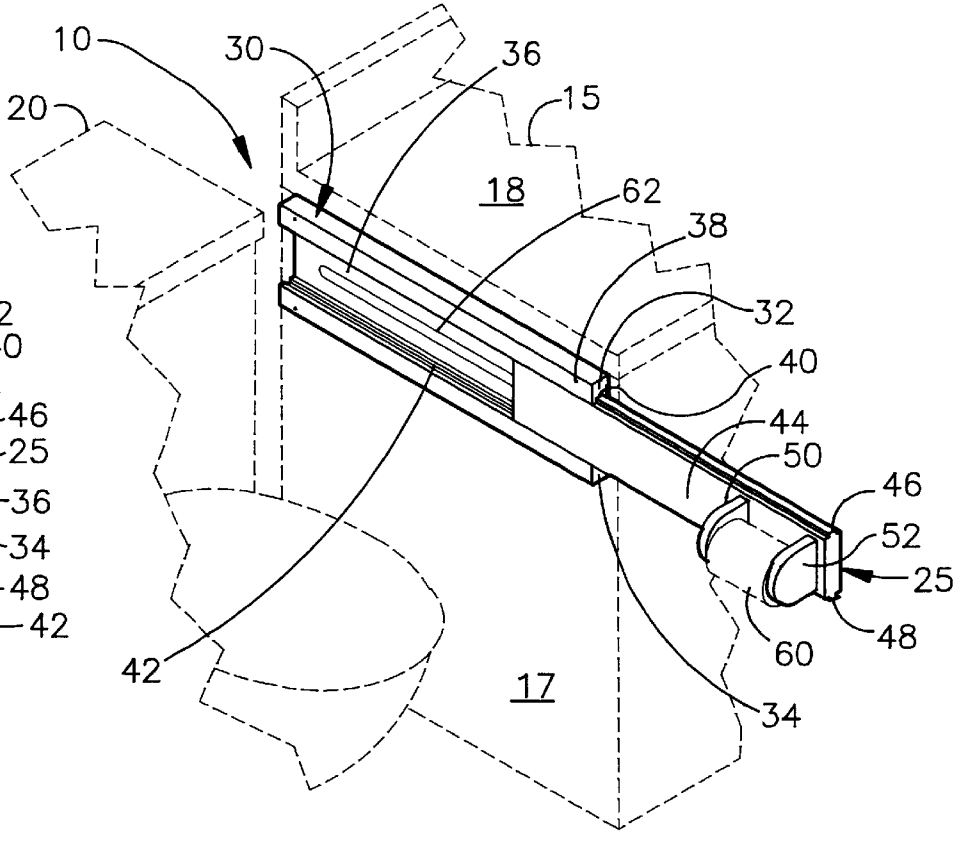
FIG. 2 is a perspective view of the toilet paper dispenser of FIG. 1 shown in its extended position.

The slider assembly 25 is composed of four major parts. The first is a generally rectangular slider 44 slidably mounted within the base assembly 30 by means of two tongues 46 and 48 which cooperate with the tracks 32 and 34 of the base assembly 30. This allows the generally rectangular slider 44 to linearly slide in the longitudinal direction from a retracted position as shown in FIG. 1 to an extended position as shown in FIG. 2. A pair of brackets 50 and 52 are mounted on one end of the generally rectangular slider 44. These brackets 50 and 52 extend transversely away from the generally rectangular slider 44 and oppose one another. Each bracket 50, 52 has a mounting hole 54 and 56 on its opposing face. The mounting holes 54 and 56 are adapted to support a mandrel 58 which extends therebetween and holds the toilet paper roll 60. Preferably mandrel 58 is constructed of two telescoping, tubular elements with a spring mounted therein. Since an arrangement is well known in the art and does not constitute part of the invention, it has not been shown in detail herein. The mandrel 58 is placed within the toilet paper roll 60 and compressed sufficiently so that it may fit between the mounting brackets 50 and 52. When the mandrel 58 aligns with the mounting holes 54 and 56, it extends due to its spring action and is thus held securely in place.

Figure 3:
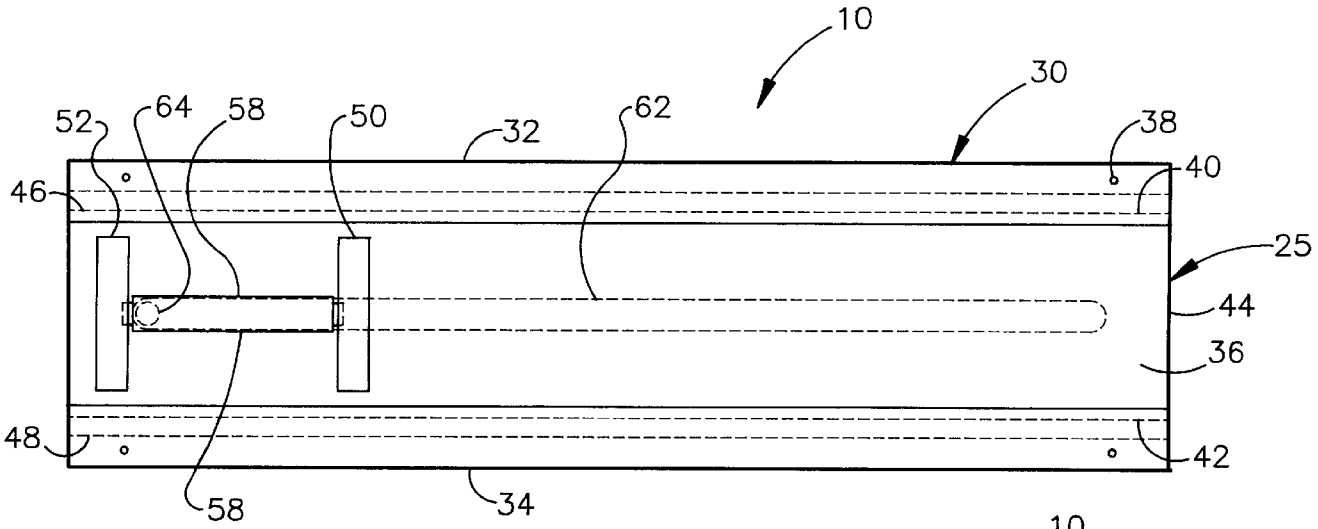
FIG. 3 is an inverted front view of the toilet paper dispenser shown in FIG. 1.
Figure 4:
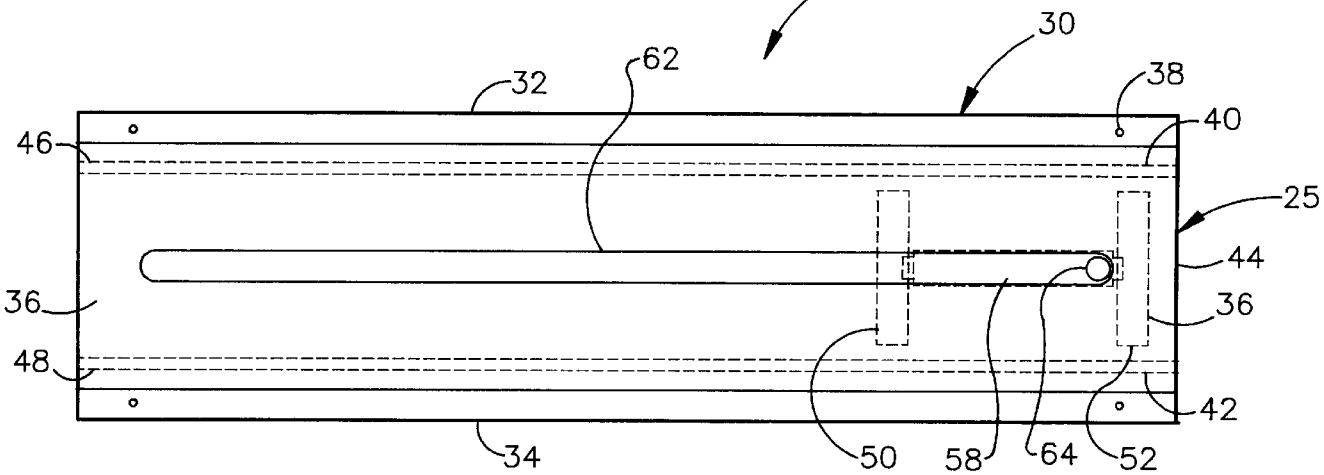
FIG. 4 is a rear view of the toilet paper dispenser shown in FIG. 3.

FIGS. 3 and 4 illustrate toilet paper dispenser 10 in its retracted position. A slot 62 is provided in the hard board backing plate 36 to limit motion of the generally rectangular slider 44. Specifically, a dowel 64 is mounted on the generally rectangular slider 44 and travels within slot 62 as the slider 44 moves back and fourth between its retracted and extended positions. As seen in FIGS. 3 and 4, when the generally rectangular slider 44 reaches its extreme retracted position, the dowel 64 abuts the end of slot 62 and, therefore, no further longitudinal motion is allowed. In practice, this prevents the generally rectangular slider 44 from traveling too far along vanity 15 and eventually hitting the back wall of the restroom.

Figures 5, 6:
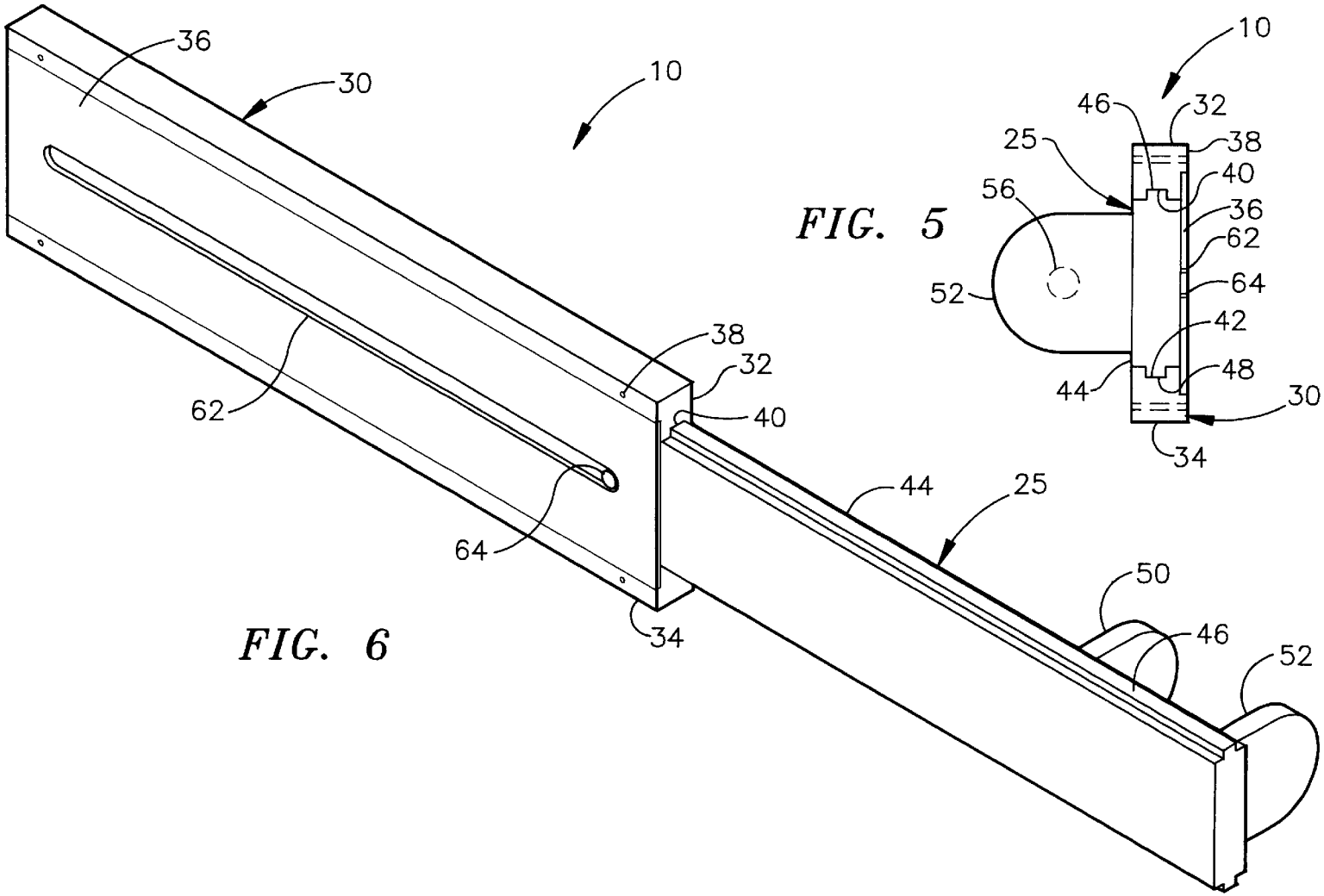
FIG. 5 is a side view of the toilet paper dispenser shown in FIG. 3.
FIG. 6 is a rear perspective view of the toilet paper dispenser shown in FIG. 3 in its extended position.

Turning now to FIG. 5, FIG. 5 shows a side view of the toilet paper dispenser 10 and clearly shows how the dowel 64 is attached to the generally rectangular slider 44 and projects into slot 62. FIG. 6, which shows a perspective view of the toilet paper dispenser 10 in its fully extended position, demonstrates how the dowel 64 will abut the second end of slot 62 when the generally rectangular slider 44 reaches its fully extended position. With this arrangement, the slider assembly 25 is restrained from completely ejecting from the base assembly 30. The illustration having dowel 64 attached to the generally rectangular slider 44 and having the slot 62 in the hard board backing plate 36 is merely an example and it should be realized that the position of these parts could be reversed or any other suitable construction could be employed which performs the guiding and stop defining functions could be employed.

In operation, someone who is using a toilet 20 need merely push slider assembly 25 to a fully extended position in order to easily access the toilet paper roll 60. This obviates the need for any twisting or bending motions to reach toilet paper roll 60. Of course, in no way is this invention intended to be limited for mounting on a vanity. Rather, it may be mounted on any suitable surface such as a short side wall or the like. Finally, when the toilet paper dispenser 10 is not in use, it may conveniently be retracted to the position shown in FIG. 1 where it is safely out of the way and will not interfere with someone using the vanity 15 or using other areas of the restroom.

Although described with respect to the preferred embodiment of the invention, it should readily be understood that the various changes and/or modifications can be made to the invention without departing from the spirit thereof. In general, the invention is only intended to be limited by the scope of the following claims.

I claim:

1. A toilet paper dispenser assembly for dispensing paper from a roll, said dispenser assembly comprising:

a base assembly adapted to be fixedly mounted to a support structure, said base assembly extending in a first longitudinal direction; and a slider assembly slidably mounted to said base assembly for sliding motion in said first longitudinal direction relative to said base assembly, said slider assembly including a toilet paper holder adapted to support a roll of toilet paper for rotation about an axis which extends in said longitudinal direction, wherein said slider assembly may be selectively placed in a retracted, non-use position and an extended position wherein said roll of toilet paper may be easily dispensed.

2. The toilet paper dispenser assembly according to claim 1, wherein the toilet paper holder includes two brackets which are longitudinally spaced along said slider assembly, said brackets being adapted to hold a supporting mandrel therebetween.

3. The toilet paper dispenser according to claim 1, wherein said base assembly includes two parallel tracks with opposing faces each having a longitudinal groove therein for supporting said slider assembly.

4. The toilet paper dispenser according to claim 3, wherein said slider assembly includes a pair of tongues respectively positioned within the grooves of said base assembly in order to accommodate the translational motion.

5. The toilet paper assembly according to claim 1, wherein one of said base assembly and said slider assembly includes a longitudinally extending slot and the other of said base assembly and said slider assembly includes a transversely extending dowel, wherein said dowel slides within said slot in order to guide said slider assembly between extended and retracted positions.

6. The toilet paper assembly according to claim 5, wherein said base assembly includes the longitudinally extending slot and said slider assembly includes the transversely extending dowel.

7. The toilet paper dispenser according to claim 6, wherein said slot is provided with an end adapted to be engaged by the dowel in order to limit the relative motion between said slider assembly and said base assembly.

8. The toilet paper dispenser according to claim 1, wherein said toilet paper dispenser is symmetrical about a longitudinal plane.

9. A toilet paper dispenser assembly paper from a roll, said dispenser assembly comprising:

a base assembly adapted to be fixedly mounted to a support structure, said base assembly extending in a first longitudinal direction; and a slider assembly slidably mounted to said base assembly for sliding motion in said first longitudinal direction relative to said base assembly, said slider assembly including a toilet paper holder adapted to support a roll of toilet paper, for rotation about an axis which extends in said longitudinal direction wherein one of said base assembly and said slider assembly includes a longitudinally extending slot and the other of said base assembly and said slider assembly includes a transversely extending dowel, wherein said dowel slides within said slot in order to guide said slider assembly between extended and retracted positions.

10. The toilet paper assembly according to claim 9, wherein said base assembly includes the longitudinally extending slot and said slider assembly includes the transversely extending dowel.

11. The toilet paper dispenser according to claim 10, wherein said slot is provided with an end adapted to be engaged by the dowel in order to limit the relative motion between said slider assembly and said base assembly.

12. The toilet paper dispenser assembly according to claim 9, wherein the toilet paper holder includes two brackets which are longitudinally spaced along said slider assembly, said brackets being adapted to hold a supporting mandrel therebetween.

13. The toilet paper dispenser according to claim 9, wherein said base assembly includes two parallel tracks with opposing faces each having a longitudinal groove therein for supporting said slider assembly.

14. The toilet paper dispenser according to claim 13, wherein said slider assembly includes a pair of tongues respectively positioned within the grooves of said base assembly in order to accommodate the translational motion.

15. The toilet paper dispenser according to claim 9, wherein said toilet paper dispenser is symmetrical about a longitudinal plane.

* * * * *